US007903065B2

(12) United States Patent
Cho et al.

(10) Patent No.: US 7,903,065 B2
(45) Date of Patent: Mar. 8, 2011

(54) LIQUID CRYSTAL DISPLAY AND DRIVING METHOD

(75) Inventors: Jae-Hyun Cho, Seoul (KR); Jung-Hwan Cho, Goyang-si (KR); Jin-Ho Park, Suwon-si (KR); Hyun-Su Lee, Anyang-si (KR)

(73) Assignee: Samsung Electronics Co., Ltd. (KR)

( * ) Notice: Subject to any disclaimer, the term of this patent is extended or adjusted under 35 U.S.C. 154(b) by 816 days.

(21) Appl. No.: 11/861,963

(22) Filed: Sep. 26, 2007

(65) Prior Publication Data

US 2008/0074569 A1 Mar. 27, 2008

(30) Foreign Application Priority Data

Sep. 27, 2006 (KR) ..... 10-2006-0094245

(51) Int. Cl.
*G09G 3/36* (2006.01)

(52) U.S. Cl. ..... 345/87; 345/97

(58) Field of Classification Search ..... 345/87–102, 345/204, 690; 349/113
See application file for complete search history.

(56) References Cited

U.S. PATENT DOCUMENTS

| | | | | |
|---|---|---|---|---|
| 6,278,427 | B1 * | 8/2001 | Matsumoto et al. | 345/88 |
| 6,476,792 | B2 | 11/2002 | Hattori et al. | |
| 6,950,172 | B2 | 9/2005 | Hattori et al. | |
| 6,975,297 | B2 * | 12/2005 | Saishu et al. | 345/94 |
| 7,034,790 | B2 * | 4/2006 | Fukami et al. | 345/94 |
| 7,084,846 | B2 * | 8/2006 | Adachi et al. | 345/89 |
| 7,427,974 | B2 * | 9/2008 | Asao et al. | 345/89 |
| 7,570,310 | B2 * | 8/2009 | Harada et al. | 349/25 |
| 7,679,589 | B2 * | 3/2010 | Park | 345/87 |
| 2003/0001813 | A1 * | 1/2003 | Sekiguchi | 345/96 |
| 2003/0071932 | A1 * | 4/2003 | Tanigaki | 349/61 |
| 2004/0066480 | A1 * | 4/2004 | Yoshida et al. | 349/123 |
| 2005/0162591 | A1 * | 7/2005 | Hashimoto | 349/113 |
| 2006/0114215 | A1 | 6/2006 | Lee et al. | |
| 2006/0152470 | A1 | 7/2006 | Kim | |
| 2008/0002109 | A1 * | 1/2008 | Ong | 349/98 |
| 2008/0137018 | A1 * | 6/2008 | Lin et al. | 349/141 |

FOREIGN PATENT DOCUMENTS

| | | |
|---|---|---|
| CN | 1804707 | 7/2006 |
| EP | 0854465 A1 | 7/1998 |
| EP | 1047039 A1 | 10/2000 |
| JP | 2002-278524 | 9/2002 |
| JP | 2002-365666 | 12/2002 |
| JP | 2003-287735 | 10/2003 |

(Continued)

OTHER PUBLICATIONS

European Search Report, EP 07018455.1-1228/1909256, Dec. 29, 2009, 7 pp.

(Continued)

*Primary Examiner* — Nitin Patel
(74) *Attorney, Agent, or Firm* — Innovation Counsel LLP

(57) ABSTRACT

An optically compensated bend (OCB) mode liquid crystal display (LCD) includes a liquid crystal display having a first substrate, a first electrode forming on the first substrate, a second substrate facing the first substrate, a second electrode formed on the second substrate and facing the first electrode, a liquid crystal layer formed between the first and second electrodes and filled with liquid crystals, and a plurality of charge supplying units supplying charges to the first electrode several times to apply a bend voltage for transiting an arrangement of the liquid crystals.

13 Claims, 8 Drawing Sheets

FOREIGN PATENT DOCUMENTS

| | | |
|---|---|---|
| JP | 2004-287451 | 10/2004 |
| KR | 1020020083247 | 11/2002 |
| KR | 1020030055851 | 7/2003 |
| KR | 1020040000781 | 1/2004 |
| KR | 1020040009900 | 1/2004 |
| KR | 1020050025204 | 3/2005 |
| KR | 1020060039873 | 5/2006 |

OTHER PUBLICATIONS

Khorshid, "Selecting charge-pump dc/dc converters", Aug. 17, 2000, pp. 115-124.

Sueoka et al., "Initialization of Optically Compensated Bend-Mode LCDs", Nov. 27, 1996, pp. 133-136.

English Abstract for WO 2005081054, Sep. 1, 2005 (corresponding to KR 20060039873).

* cited by examiner

LIQUID CRYSTAL DISPLAY AND DRIVING METHOD

CROSS-REFERENCE TO RELATED APPLICATION

This application claims priority to and the benefit of Korean Patent Application No. 10-2006-0094245 filed in the Korean Intellectual Property Office on Sep. 27, 2006, the entire contents of which are incorporated herein by reference.

BACKGROUND OF THE INVENTION

1. Field of the Invention

The present invention relates to a liquid crystal display, and in particular, to an optically compensated bend mode liquid crystal display.

2. Description of the Related Art

Liquid crystal displays (LCDs) are one type of flat panel displays that are now widely used. The LCD includes two display panels in which field generating electrodes such as pixel electrodes and a common electrode are formed, respectively, and a liquid crystal (LC) layer interposed between the display panels. A voltage applied to the pixel electrodes and the common electrode generates an electric field in the LC layer which determines the orientation of the LC molecules and controls the polarization of incident light to display images.

Various methods have been proposed to improve the response speed and the reference viewing angle of the LCD. An example thereof is an optically compensated bend (OCB) mode LCD.

In the OCB mode LCD, the applied electric field changes the alignment of LC molecules from a horizontal arrangement to a vertical arrangement until the LC molecules reach from the display panel surfaces to the center of an area between the display panels. In the OCB mode display, the LC molecules are symmetrically arranged from the two display panels to the center of the area.

However, the OCB mode LCD is unstable compared with LCDs of another mode and, when a voltage is not applied, the LC molecules have a splay alignment. It would be of great advantage if the alignment of the LC molecules could be changed from the splay alignment to a bend alignment for more effective displaying of images.

SUMMARY OF THE INVENTION

An exemplary embodiment of the present invention provides a liquid crystal display including a first substrate, a first electrode forming on the first substrate, a second substrate facing the first substrate, a second electrode formed on the second substrate and facing the first electrode, a liquid crystal layer formed between the first and second electrodes and filled with liquid crystals, and a plurality of charge supplying units supplying charges to the first electrode several times to apply a bend voltage for transiting an arrangement of the liquid crystals.

The alignment of the liquid crystals may be changed from a splay alignment to a bend alignment by the alignment transition of the liquid crystals.

The charge supplying unit may apply the bend voltage to the first electrode before the liquid crystal display displays images.

The charge supplying unit may apply a common voltage to the first electrode during the liquid crystal display displays images.

The charge supplying unit may include a capacitor connected to the common voltage and a reference node, a first switching element connected to the bend voltage source and the reference node, and a second switching element connected to the reference node and the first electrode.

The first and second switching elements may be alternately turned on.

The bend voltage may be larger than the common voltage.

The charge supplying unit may further include a third switching element connected to the common voltage and the first electrode, and the third switching element may be turned on after the first electrode is charged with the bend voltage.

The bend voltage may increase as time elapses.

Another embodiment of the present invention provides a driving method of a liquid crystal display having a first substrate, a first electrode forming on the first substrate, a second substrate facing the first substrate, a second electrode formed on the second substrate and facing the first electrode, and a liquid crystal layer formed between the first and second electrodes and filled with liquid crystals, the driving method including supplying charges to the first electrode several times to apply a bend voltage for transiting an arrangement of the liquid crystals, applying a common voltage to the first electrode, and applying a data voltage to the second electrode to display an image.

The charge supplying unit may include a capacitor connected to the common voltage and a reference node, a first switching element connected to the bend voltage and the reference node, and a second switching element connected to the reference node and the first electrode. Moreover, the charge supplying may include supplying the bend voltage to the capacitor to charge it by turning on of the first switching element, and supplying the charge charged in the capacitor to the first electrode by turning on the second switching element.

The bend voltage may be larger than the common voltage.

The bend voltage may increase as time elapses.

BRIEF DESCRIPTION OF THE DRAWINGS

An exemplary embodiment of the present invention will be described in detail with reference to the accompanying drawings for clear understanding of advantages of the present invention, wherein.

DETAILED DESCRIPTION OF THE EMBODIMENTS

Figure 1:
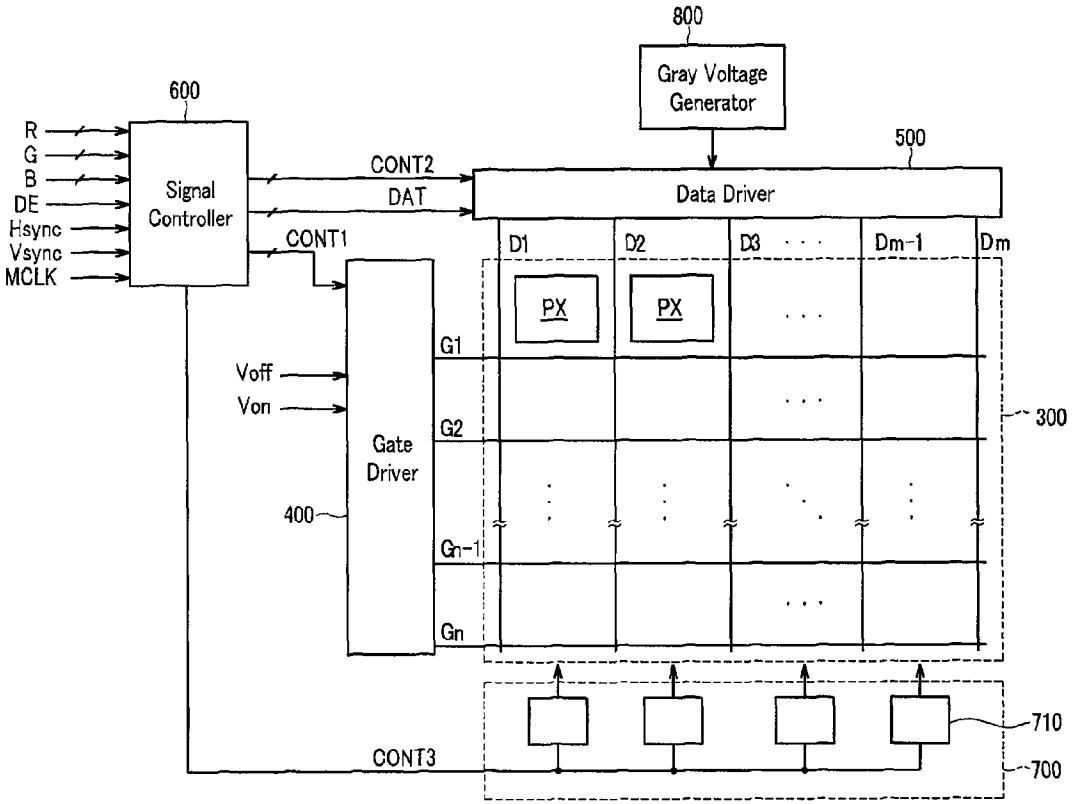
FIG. 1 is a block diagram of an LCD according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

An LCD according to an exemplary embodiment of the present invention will be described with reference to FIG. 1 and FIG. 2.

Figure 2:
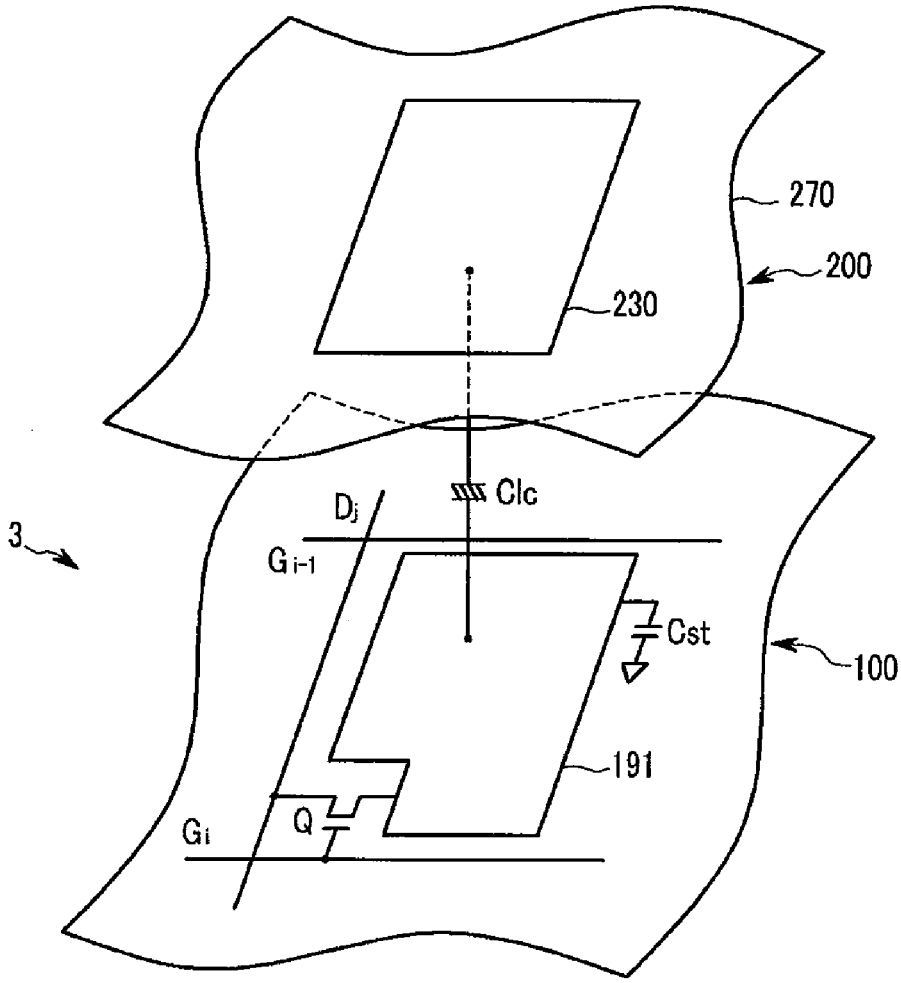
FIG. 2 is an equivalent circuit diagram of a pixel of an LCD according to an exemplary embodiment of the present invention.

FIG. 1 is a block diagram of an LCD according to an exemplary embodiment of the present invention, and FIG. 2 is an equivalent circuit diagram of a pixel of an LCD according to an exemplary embodiment of the present invention.

Referring to FIG. 1, an LCD according to an exemplary embodiment of the present invention includes an LC panel assembly 300, a gate driver 400 and a data driver 500 that are coupled with the LC panel assembly 300, a gray voltage generator 800 coupled with the data driver 500, a charge supplying unit 700, and a signal controller 600 controlling the above elements.

The panel assembly 300 includes a plurality of signal lines $G_1$-$G_n$ and $D_1$-$D_m$ and a plurality of pixels PX connected to the signal lines $G_1$-$G_n$ and $D_1$-$D_m$ and arranged substantially in a matrix. In the structural view shown in FIG. 2, the panel assembly 300 includes lower and upper panels 100 and 200 facing each other and an LC layer 3 interposed between the panels 100 and 200.

The signal lines include a plurality of gate lines $G_1$-$G_n$ transmitting gate signals (also referred to as "scanning signals" hereinafter) and a plurality of data lines $D_1$-$D_m$ transmitting data voltages. The gate lines $G_1$-$G_n$ extend substantially in a row direction and substantially parallel to each other, while the data lines $D_1$-$D_m$ extend substantially in a column direction and substantially parallel to each other.

Referring to FIG. 2, each pixel PX, for example a pixel PX connected to the i-th gate line $G_i$ (i=1, 2, . . . , n) and the j-th data line $D_j$ (j=1, 2, . . . , m), includes a switching element Q connected to the signal lines $G_i$ and $D_j$, and an LC capacitor Clc and a storage capacitor Cst that are connected to the switching element Q. The storage capacitor Cst may be omitted.

The switching element Q such as a thin film transistor (TFT) is located on the lower panel 100 and has three terminals, i.e., a control terminal connected to the gate line $G_i$, an input terminal connected to the data line $D_j$, and an output terminal connected to the LC capacitor Clc and the storage capacitor Cst. The TFT may include polysilicon or amorphous silicon.

The LC capacitor Clc includes a pixel electrode 191 disposed on the lower panel 100 and a common electrode 270 disposed on the upper panel 200 as two terminals. The LC layer 3 located between the two electrodes 191 and 270 functions as the dielectric of the LC capacitor Clc. The pixel electrode 191 is connected to the switching element Q, and the common electrode 270 is supplied with a common voltage Vcom and covers an entire surface of the upper panel 200. Unlike in FIG. 2, the common electrode 270 may be provided on the lower panel 100, and at least one of the electrodes 191 and 270 may have a shape of a bar or a stripe.

The storage capacitor Cst is an auxiliary capacitor for the LC capacitor Clc. The storage capacitor Cst includes the pixel electrode 191 and a separate signal line that is provided on the lower panel 100, overlaps the pixel electrode 191 via an insulator, and is supplied with a predetermined voltage such as the common voltage Vcom. Alternatively, the storage capacitor Cst includes the pixel electrode 191 and an adjacent gate line called a previous gate line, which overlaps the pixel electrode 191 via an insulator.

For color display, each pixel uniquely represents one of primary colors (i.e., spatial division) or each pixel sequentially represents the primary colors in turn (i.e., temporal division) such that a spatial or temporal sum of the primary colors is recognized as a desired color. An example of a set of the primary colors includes red, green, and blue colors. FIG. 2 shows an example of the spatial division in which each pixel includes a color filter 230 representing one of the primary colors in an area of the upper panel 200 facing the pixel electrode 191. Alternatively, the color filter 230 is provided on or under the pixel electrode 191 on the lower panel 100.

One or more polarizers (not shown) are attached to the panel assembly 300.

The structure of the LC panel assembly 300 will be described in detail with reference to FIG. 3 and FIG. 4.

Figure 3:
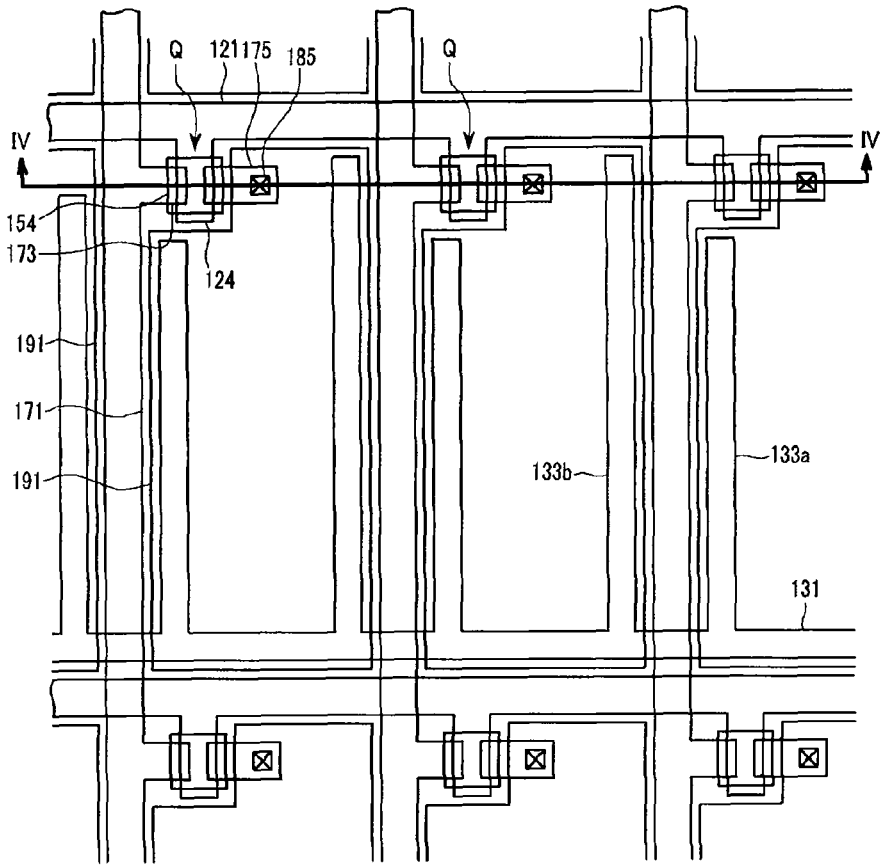
FIG. 3 is a layout view of a LC panel assembly of an LCD according to an embodiment of the present invention.
Figure 4:
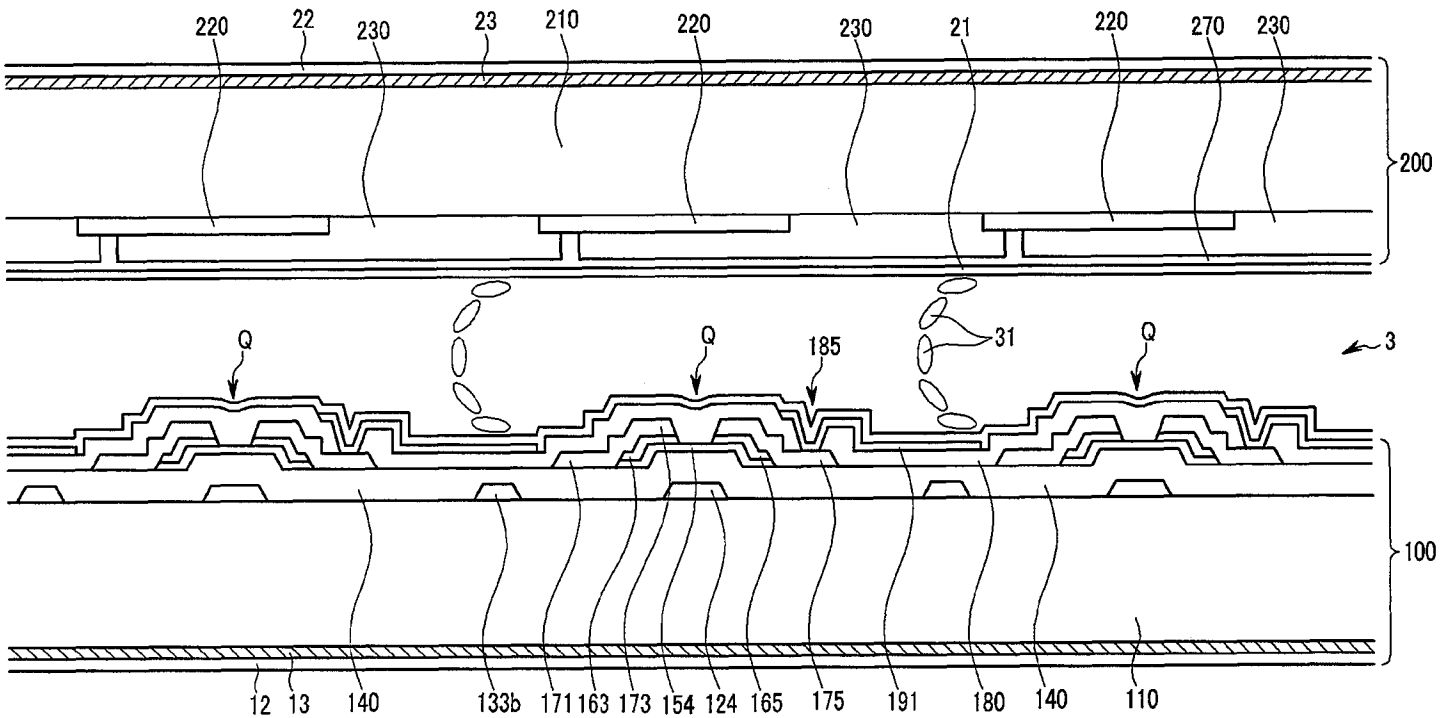
FIG. 4 is a cross-sectional view of the LCD panel assembly shown in FIG. 3 taken along the line IV-IV.

FIG. 3 is a layout view of a LC panel assembly of an LCD according to an embodiment of the present invention, and FIG. 4 is a cross-sectional view of the LCD panel assembly shown in FIG. 3 taken along the line IV-IV.

Referring to FIG. 3 and FIG. 4, as described above, an LCD according to an exemplary embodiment of the present invention includes a lower panel 100, an upper panel 200 opposite to the lower panel 100, and an LC layer 3 having LC molecules that is disposed between the two panels.

First, the lower panel 100 will be described.

A plurality of gate lines 121 and a plurality of storage electrode lines 131 are formed on an insulating substrate 110 that is made of a material such as transparent glass or plastic.

The gate lines 121 transmit gate signals and extend substantially in a transverse direction. Each of the gate lines 121 includes a plurality of gate electrodes 124 projecting downward and an end portion (not shown) having a large area for contact with another layer or an external driving circuit. A gate driving circuit (not shown) for generating the gate signals may be mounted on a flexible printed circuit (FPC) film (not shown), which may be attached to the substrate 110, directly mounted on the substrate 110, or integrated with the substrate 110. The gate lines 121 extend to be connected to a driving circuit that may be integrated with the substrate 110.

The storage electrode lines 131 are supplied with a predetermined voltage, and each of the storage electrode lines 131 includes a stem extending substantially parallel to the gate lines 121 and a plurality of pairs of storage electrodes 133*a* and 133*b* branched from the stem. Each of the storage electrode lines 131 is located between two adjacent gate lines 121, and the stem is close to one of the two adjacent gate lines 121. Each of the storage electrodes 133*a* and 133*b* has a fixed end portion connected to the stem and a free end portion located opposite thereto. However, the storage electrode lines 131 may have various shapes and arrangements.

The gate lines 121 and the storage electrode lines 131 may be preferably made of an Al-containing metal such as Al and an Al alloy, a Ag-containing metal such as Ag and a Ag alloy, a Cu—containing metal such as Cu and a Cu alloy, a Mo—containing metal such as Mo and a Mo alloy, Cr, Ta, or Ti. However, they may have a multi-layered structure including two conductive films (not shown) having different physical characteristics. One of the two films may be made of a low resistivity metal including an Al—containing metal, an Ag—containing metal, and a Cu—containing metal for reducing signal delay or voltage drop. The other film may be made of a material such as a Mo-containing metal, Cr, Ta, or Ti, which has good physical, chemical, and electrical contact characteristics with other materials such as indium tin oxide (ITO) or indium zinc oxide (IZO). Good examples of the combination of the two films are a lower Cr film and an upper Al (alloy) film and a lower Al (alloy) film and an upper Mo (alloy) film. However, the gate lines 121 and the storage electrode lines 131 may be made of various metals or conductors.

The lateral sides of the gate lines 121 and the storage electrode lines 131 are inclined relative to the surface of the substrate 110, and the inclination angle thereof is in the range from about 30 to 80 degrees.

A gate insulating layer 140 preferably made of silicon nitride (SiNx) or silicon oxide (SiOx) is formed on the gate lines 121 and the storage electrode lines 131.

A plurality of semiconductor islands 154 preferably made of hydrogenated amorphous silicon (abbreviated to "a-Si") or polysilicon are formed on the gate insulating layer 140. The semiconductor islands 154 are disposed on the gate electrodes 124.

A plurality of ohmic contact islands 163 and 165 are formed on the semiconductor islands 154. The ohmic contact islands 163 and 165 are preferably made of n+ hydrogenated a-Si heavily doped with an n-type impurity such as phosphorous, or they may be made of silicide. The ohmic contact islands 163 and 165 are located in pairs on the semiconductor islands 154.

The lateral sides of the semiconductor islands 154 and the ohmic contacts 163 and 165 are inclined relative to the surface of the substrate 110, and the inclination angles thereof are preferably in the range from about 30 to 80 degrees.

A plurality of data lines 171 and a plurality of drain electrodes 175 are formed on the ohmic contact islands 163 and 165 and the gate insulating layer 140.

The data lines 171 transmit data signals and extend substantially in the longitudinal direction to intersect the gate lines 121. Each of the data lines 171 also intersects the storage electrode lines 131 and runs between adjacent pairs of storage electrodes 133*a* and 133*b*. Each of the data lines 171 also intersects the stem of each storage electrode line 131. Each data line 171 includes a plurality of source electrodes 173 projecting toward the gate electrodes 124 and an end portion (not shown) having a large area for contact with another layer or an external driving circuit. A data driving circuit (not shown) for generating the data signals may be mounted on an FPC film (not shown), which may be attached to the substrate 110, directly mounted on the substrate 110, or integrated with the substrate 110. The data lines 171 extend to be connected to a driving circuit that may be integrated with the substrate 110.

The drain electrodes 175 are separated from the data lines 171 and located opposite the source electrodes 173 with respect to the gate electrodes 124.

A gate electrode 124, a source electrode 173, and a drain electrode 175 along with a semiconductor island 154 form a TFT having a channel formed in the semiconductor island 154 disposed between the source electrode 173 and the drain electrode 175.

The data lines 171 and the drain electrodes 175 may be made of a refractory metal such as Cr, Mo, Ta, Ti, or alloys thereof. However, they may have a multi-layered structure including a refractory metal film (not shown) and a low resistivity film (not shown). Good examples of the multi-layered structure are a double-layered structure including a lower Cr/Mo (alloy) film and an upper Al (alloy) film, and a triple-layered structure of a lower Mo (alloy) film, an intermediate Al (alloy) film, and an upper Mo (alloy) film. However, the data lines 171 and the drain electrodes 175 may be made of various metals or conductors.

The data lines 171 and the drain electrodes 175 have inclined edge profiles, and the inclination angles thereof are in the range from about 30 to 80 degrees.

The ohmic contact islands 163 and 165 are interposed only between the underlying semiconductor islands 154 and the overlying data lines 171 and drain electrodes 175 thereon, and reduce contact resistance therebetween.

A passivation layer 180 is formed on the data lines 171, the drain electrodes 175, and the exposed portions of the semiconductor islands 154.

The passivation layer 180 may be made of an inorganic or organic insulator and it may have a flat top surface. Examples of the inorganic insulator include silicon nitride and silicon oxide. The organic insulator may have photosensitivity and a dielectric constant of less than about 4.0. The passivation layer 180 may include a lower film of an inorganic insulator and an upper film of an organic insulator such that it takes the excellent insulating characteristics of the organic insulator while preventing the exposed portions of the semiconductor islands 154 from being damaged by the organic insulator.

The passivation layer 180 has a plurality of contact holes (not shown) exposing the end portions of the data lines 171 and a plurality of contact holes 185 exposing the drain electrodes 175, respectively. The passivation layer 180 and the gate insulating layer 140 have a plurality of contact holes (not shown) exposing the end portions of the gate lines 121.

A plurality of pixel electrodes 191 and a plurality of contact assistants (not shown) are formed on the passivation layer 180. They may be made of a transparent conductor such as ITO or IZO or a reflective conductor such as Ag, Al, Cr, or alloys thereof.

The pixel electrodes 191 are physically and electrically connected to the drain electrodes 175 through the contact holes 185 such that the pixel electrodes 191 receive data voltages from the drain electrodes 175. The pixel electrodes 191 supplied with the data voltages generate electric fields in cooperation with the common electrode 270 of an opposing display panel 200 supplied with a common voltage, which determine the orientations of the LC molecules 31 of the LC layer 3 disposed between the two electrodes 191 and 270. A pixel electrode 191 and the common electrode 270 form an LC capacitor, which stores applied voltages after the TFT turns off.

A pixel electrode 191 overlaps a storage electrode line 131 including storage electrodes 133*a* and 133*b*. The pixel electrode 191 and a drain electrode 175 electrically connected thereto and the storage electrode line 131 form a storage capacitor, which enhances the voltage storing capacity of the LC capacitor.

The contact assistants are connected to the end portions of the gate lines 121 and the data lines 171 through the contact holes, respectively. The contact assistants protect the end portions of the gate lines 121 and the data lines 171 and enhance the adhesion between the end portions 129 and 179 and external devices.

The description of the upper panel 200 follows with reference to FIG. 4.

A light blocking member 220 referred to as a black matrix for preventing light leakage is formed on an insulating substrate 210 made of a material of such as transparent glass or plastic. The light blocking member 220 include a plurality of rectilinear portions facing the data lines 171 on the lower array panel 100 and a plurality of widened portions facing the TFTs on the lower array panel 100.

A plurality of color filters 230 are formed on the substrate 210, and are disposed substantially in the areas enclosed by the light blocking member 220. The color filters 230 may extend substantially in the longitudinal direction along the pixel electrodes 191. The color filters 230 may represent one of the primary colors such as red, green, and blue colors.

An overcoat (not shown) may be formed on the color filters 230 and the light blocking member 220. The overcoat may be made of an (organic) insulator, and it prevents the color filters 230 from being exposed and provides a flat surface. The overcoat may be omitted.

A common electrode 270 is formed on the color filters 230 and the black matrix 220. The common electrode 270 may be made of a transparent conductive material such as ITO and IZO.

Alignment layers 11 and 21 that may be homogeneous and rubbed in the same direction are coated on the inner surfaces of the panels 100 and 200.

Polarizers 12 and 22 are provided on the outer surfaces of the panels 100 and 200 so that their polarization axes may be crossed and one of the polarization axes may be parallel to the gate lines 121. One of the polarizers 12 and 22 may be omitted when the LCD is a reflective LCD.

The LCD further include compensation films 13 and 23 between the polarizers 12 and 22 and the panels 100 and 200, respectively. The compensation films 13 and 23 may be a C plate retardation film, a biaxial compensation film, etc.

The LC layer 3 includes nematic liquid crystals having positive dielectric anisotropy. The liquid crystals are initially aligned in a splay direction. However, by applying a bend voltage to the liquid crystals, the alignment direction of the liquid crystals is changed to a bending direction as shown in FIG. 4. The display is formed in this state. An OCB mode LCD has a normally white mode in which white is displayed when a voltage is not applied.

Referring to FIG. 1 again, the gray voltage generator 800 generates a full number of gray voltages or a limited number of gray voltages (referred to as "reference gray voltages" hereinafter) related to the transmittance of the pixels PX. Some of the (reference) gray voltages have a positive polarity relative to the common voltage Vcom, while the other of the (reference) gray voltages have a negative polarity relative to the common voltage Vcom.

The gate driver 400 is connected to the gate lines $G_1$-$G_n$ of the panel assembly 300 and synthesizes a gate-on voltage Von and a gate-off voltage Voff to generate the gate signals for application to the gate lines $G_1$-$G_n$.

The data driver 500 is connected to the data lines $D_1$-$D_m$ of the panel assembly 300 and applies data voltages, which are selected from the gray voltages supplied from the gray voltage generator 800, to the data lines $D_1$-$D_m$. However, when the gray voltage generator 800 generates only a few of the reference gray voltages rather than all the gray voltages, the data driver 500 may divide the reference gray voltages to generate the data voltages from among the reference gray voltages.

The charge supplying unit 700 includes a plurality of charge supplying circuits 710. The charge supplying circuits 710 are disposed on an edge region of the lower panel 100. The charge supplying unit 700 supplies the common voltage or a bend voltage to the common electrode 270 of the upper panel 200 through a short point (not shown) of the lower panel 100.

Each of the charge supplying circuits will be described in detail later.

The signal controller 600 controls the gate driver 400, the data driver 500, the charge supplying unit 700, etc.

Each of driving devices 400, 500, 600, 700, and 800 may include at least one integrated circuit (IC) chip mounted on the LC panel assembly 300 or on a flexible printed circuit (FPC) film in a tape carrier package (TCP) type, which are attached to the panel assembly 300. Alternatively, at least one of the driving devices 400, 500, 600, 700, and 800 may be integrated with the panel assembly 300 along with the signal lines $G_1$-$G_n$ and $D_1$-$D_m$ and the switching elements Q. Alternatively, all the driving devices 400, 500, 600, and 800 may be integrated into a single IC chip, but at least one of the driving devices 400, 500, 600, 700, and 800 or at least one circuit element in at least one of the processing units devices 400, 500, 600, 700, and 800 may be disposed outside of the single IC chip.

Next, the alignment transition of the LC layer 3 using the charge supplying unit 700 will be described with reference to FIG. 5 and FIG. 6.

Figure 5:
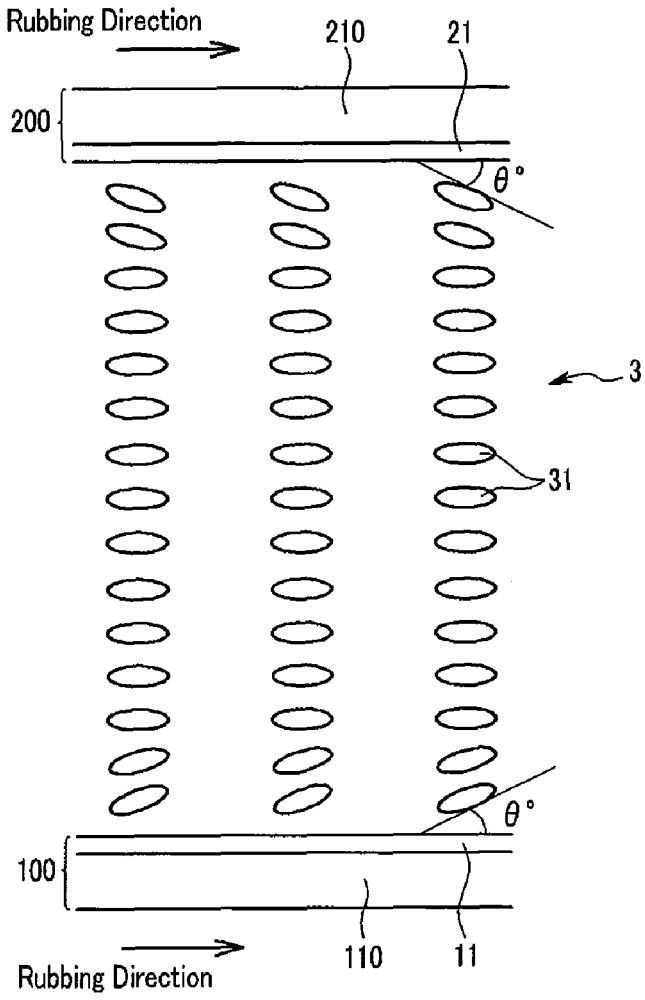
FIG. 5 is a diagram showing an alignment state of liquid crystals before applying a bend voltage.
Figure 6:
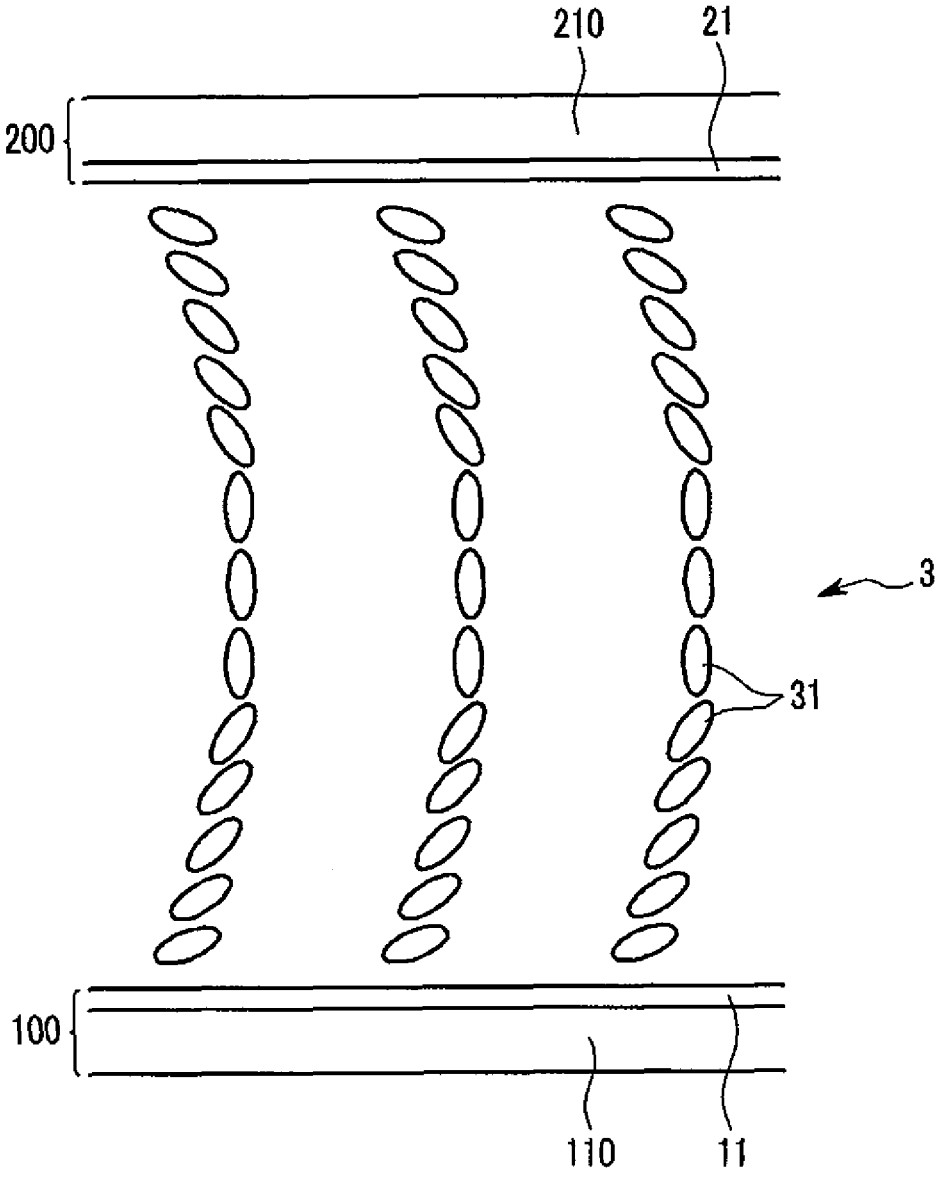
FIG. 6 is a diagram showing an alignment state of liquid crystals after applying a bend voltage.

FIG. 5 is a diagram showing the alignment state of liquid crystals before applying a bend voltage, and FIG. 6 is a diagram showing an alignment state of liquid crystals after applying a bend voltage.

FIG. 5, shows the state when no bend voltage is applied The LC molecules 31 near the two alignment layers 11 and 21 are horizontally aligned at a linear tilt angle (θ) in which one end is raised toward the rubbing direction. Therefore, the alignments of the LC molecules 31 are close to parallel to the surfaces of the substrates 110 and 210 and are distributed throughout the thickness of the LC layer 3 approximately symmetrically with respect to the center of an area (hereinafter, referred to as a "central area") that is located at approximately the same distance from each of the surfaces of the two alignment layers 11 and 21. Such an alignment is called a "splay alignment".

In this state, if an electric field is applied to the LC layer 3, the alignment of the LC molecules 31 is changed from the splay alignment to other alignments.

If a voltage begins to be applied to the electrodes (not shown) of the two display panels 100 and 200, and an electric field that is vertical to the surfaces of the two display panels 100 and 200 is generated in the LC layer 3, the LC molecules 31 near the alignment layers 11 and 21 stand up in response to the electric field. However, since the direction in which the LC molecules 31 stand up at the surfaces of the two alignment layers 11 and 21 is the same, the LC molecules 31 collide with each other in the central portion of the LC layer 3. Accordingly, high stress is generated which is transferred to a stable twist alignment in terms of energy. This is called a "transient splay alignment".

In this state, if an electric field becomes strong, the liquid crystals result in a bending alignment as shown in FIG. 6. Such alignment transition should uniformly occur in the LC capacitor Clc of the entire LC panel assembly 300.

Next, the structure of the charge supplying circuit according to an exemplary embodiment of the present invention will be described with reference to FIG. 7 and FIG. 8.

Figure 7:
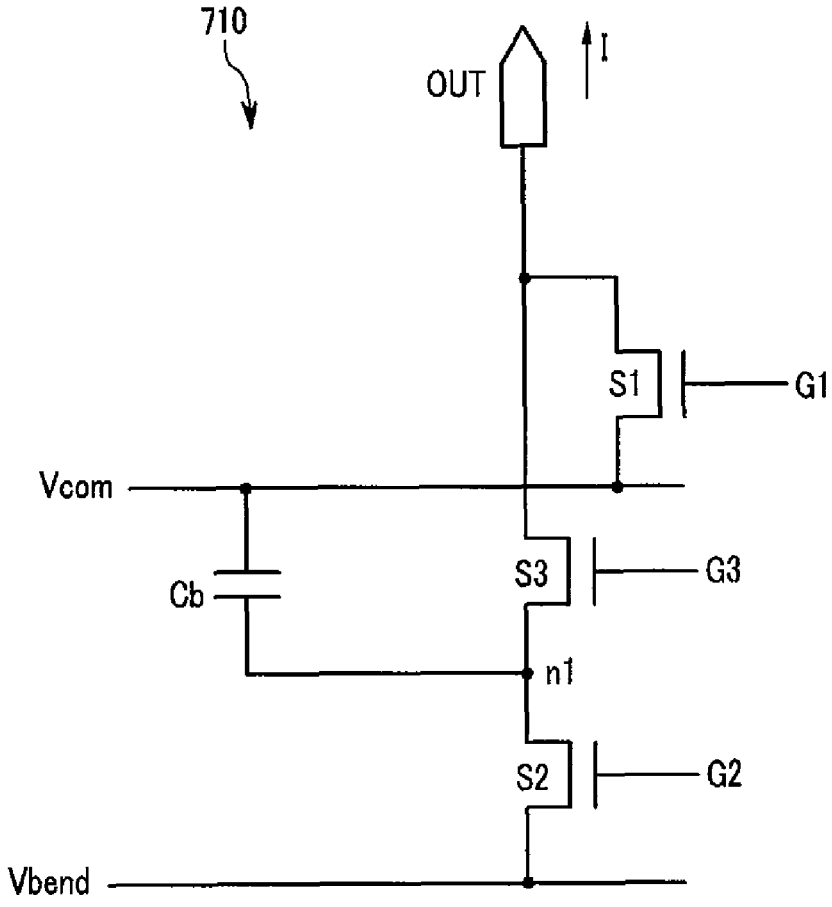
FIG. 7 is an equivalent circuit diagram of a charge supplying unit according to an exemplary embodiment of the present invention.
Figure 8:
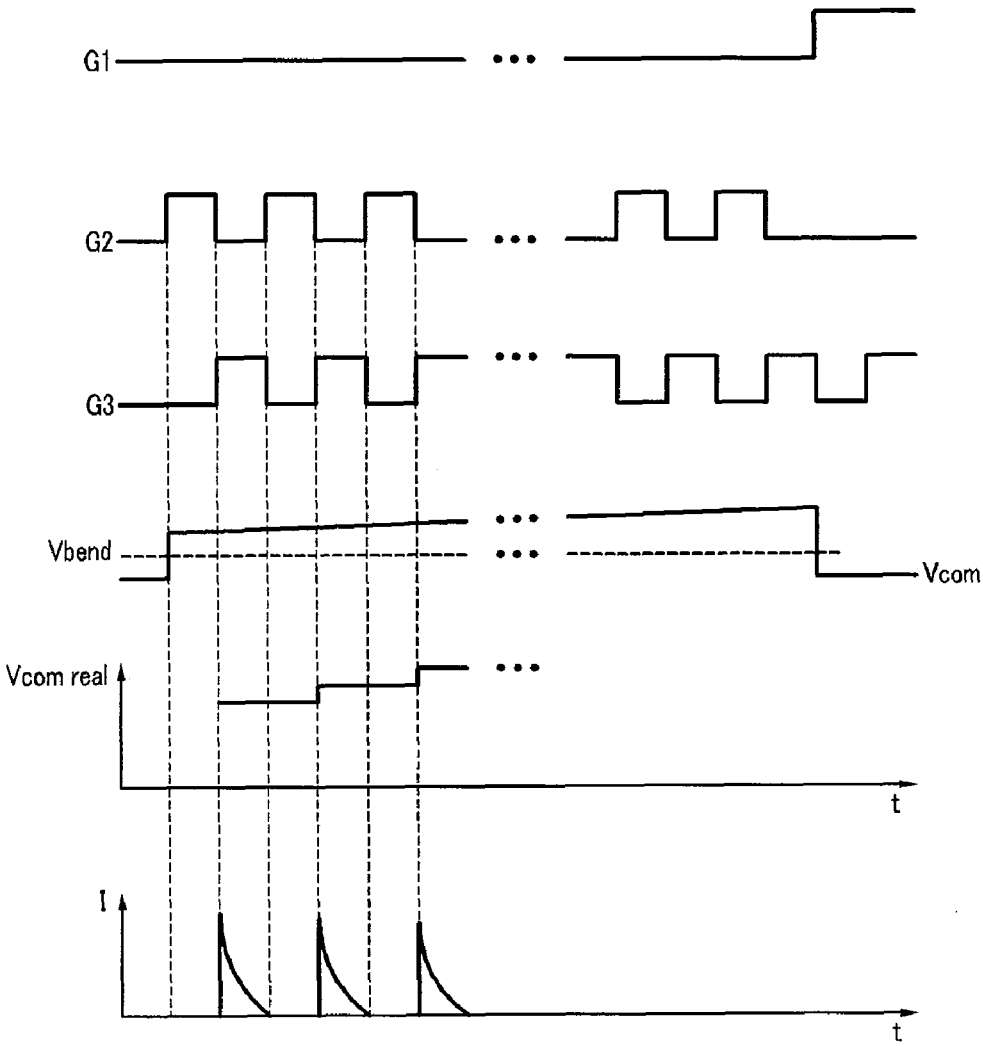
FIG. 8 is a waveform diagram with respect to signals used in an LCD according to an exemplary embodiment of the present invention.

FIG. 7 is an equivalent circuit diagram of a charge supplying unit according to an exemplary embodiment of the present invention, and FIG. 8 is a waveform diagram with respect to signals used in an LCD according to an exemplary embodiment of the present invention.

Referring to FIG. 7, each of the charge supplying circuits 710 includes a capacitor Cb and a plurality of switching elements S1, S2, and S3.

The switching element S1 has three terminals: a control terminal connected to a first control signal G1, an input terminal connected to the common voltage Vcom, and an output terminal connected to an output terminal OUT.

The switching element S2 also has three terminals such as a control terminal connected to a second control signal G2, an input terminal connected to a bend voltage Vbend, and an output terminal connected to a node n1.

The switching element S 3 has three terminals such as a control terminal connected to a third control signal G3, an input terminal connected to the node n1, and an output terminal connected to the output terminal OUT.

The capacitor Cb is connected between the common voltage Vcom and the node n1.

The output terminal OUT of each charge supplying circuit 710 is connected to the common electrode 270 of the upper panel 200 through a short point of the lower panel 100.

The operation of the LCD will now be described.

When signal controller 600 is supplied with the power, an alignment control signals CONT3 is output to the charge supplying unit 700. The alignment control signals CONT3 includes the first to third control signals G1, G2, and G3.

When the second control signal G2 has a high level, the switching element S2 of each charge supplying circuit 710 is turned on to transmit the bend voltage Vbend to the node n1. The bend voltage Vbend is a DC voltage, and has a level higher than the common voltage Vcom.

The capacitor Cb outputs charges corresponding to the differential voltage between the common voltage Vcom and the bend voltage Vbend.

When the level of the third control signal G3 is changed to a high level and the level of the second control signal G2 is changed to a low level, the switching element S2 is turned off, and the switching element S3 is turned on.

Thereby, current flows from the capacitor Cb to the LC capacitor Clc according to the voltage difference between the capacitor Cb and the LC capacitor Clc such that the charges on capacitor Cb are transferred to the LC capacitor Clc connected to the common electrode 270 through the output terminal OUT.

The operations of the switching elements S2 and S3 are repeated several times, but the entire common electrode 270 has a uniform voltage such as the bend voltage produced by the charges on the LC capacitor Clc. Hence, the alignment state of the liquid crystals of the LC layer 3 transits to the bend alignment because of the electric fields corresponding to the bend voltage Vbend.

As the present voltage $Vcom_{real}$ of the common electrode 270 is close to the bend voltage Vbend, current peaks of the two capacitors Cb and Clc become lower, respectively, and thereby the charge amount transferred from the capacitor Cb to the LC capacitor Clc is reduced. Therefore, as the turn-on or turn-off of the switching elements S2 and S3 is repeated, the level of the bend voltage Vbend increases. Thereby, the charge amount transferred between the capacitors Cb and Clc increases, and the LC capacitor Clc is uniformly charged for a short time.

While the switching elements S2 and S3 repeat being turned on and off, the switching element S1 maintains a turned-off state.

When the alignment transition of the LC layer 3 is finished, the level of the first and second control signals G1 and G2 is changed to the low level, and the level of the third control signal G3 is changed to the high level.

Accordingly, the switching elements S2 and S3 are turned off and the switching element S1 is turned on, and thereby the common voltage Vcom is applied to the common electrode 270 through the output terminal OUT.

When the common voltage Vcom has been applied to the common electrode 270, the signal controller 600 is supplied with input image signals R, G, and B and input control signals from an external graphics controller (not shown). The input image signals R, G, and B contain luminance information of pixels PX, and the luminance has a predetermined number of grays, for example 1024 ($=2^{10}$), 256 ($=2^{8}$), or 64 ($=2^{6}$) grays. The input control signals include a vertical synchronization signal Vsync, a horizontal synchronization signal Hsync, a main clock signal MCLK, and a data enable signal DE.

On the basis of the input control signals and the input image signals R, G, and B, the signal controller 600 generates gate control signals CONT1 and data control signals CONT2, and it processes the image signals R, G, and B to be suitable for the operation of the panel assembly 300 and the data driver 500. The signal controller 600 sends the gate control signals CONT1 to the gate driver 400 and sends the processed image signals DAT and the data control signals CONT2 to the data driver 500.

The gate control signals CONT1 include a scanning start signal STV for instructing to start scanning, and at least one clock signal for controlling the output period of the gate-on voltage Von. The gate control signals CONT1 may include an output enable signal OE for defining the duration of the gate-on voltage Von.

The data control signals CONT2 include a horizontal synchronization start signal STH for controlling the start of data transmission for a row of pixels PX, a load signal LOAD for instructing to apply the data voltages to the data lines $D_1$-$D_m$, and a data clock signal HCLK. The data control signal CONT2 may further include an inversion signal RVS for reversing the polarity of the data voltages (relative to the common voltage Vcom).

Responsive to the data control signals CONT2 from the signal controller 600, the data driver 500 receives a packet of the digital image signals DAT for the row of pixels PX from the signal controller 600, converts the digital image signals DAT into analog data voltages selected from the gray voltages, and applies the analog data voltages to the data lines $D_1$-$D_m$.

The gate driver 400 applies the gate-on voltage Von to a gate line $G_1$-$G_n$ in response to the gate control signals CONT1 from the signal controller 600, thereby turning on the switching transistors Q connected thereto. The data voltages applied to the data lines $D_1$-$D_m$ are then supplied to the pixels PX through the activated switching transistors Q.

The difference between the voltage of a data voltage and the common voltage Vcom applied to a pixel PX is represented as a voltage across the LC capacitor Clc of the pixel PX, which is referred to as a pixel voltage. The LC molecules in the LC capacitor Clc have orientations depending on the magnitude of the pixel voltage, and the molecular orientations determine the polarization of light passing through the LC layer 3. The polarizer(s) converts light polarization to light transmittance such that the pixel PX has a luminance represented by a gray of the data voltage.

By repeating this procedure for a unit of the horizontal period (also referred to as "1H" that is equal to one period of the horizontal synchronization signal Hsync and the data enable signal DE), all gate lines $G_1$-$G_n$ are sequentially supplied with the gate-on voltage Von, thereby applying the data voltages to all pixels PX to display an image for a frame.

When the next frame starts after one frame finishes, the inversion signal RVS applied to the data driver 500 is controlled such that the polarity of the data voltages is reversed (which is referred to as "frame inversion"). The inversion signal RVS may be also controlled such that the polarity of the data voltages flowing in a data line is periodically reversed during one frame (for example row inversion and dot inversion), or the polarity of the data voltages in one packet is reversed (for example column inversion and dot inversion).

According to the present invention, charges corresponding to a bend voltage are repeatedly supplied to an LC capacitor such that a bend voltage is uniformly applied to the entire common electrode to transit an alignment of liquid crystals to a bend alignment for a short time.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A liquid crystal display comprising:

a first substrate;

a first electrode formed on the first substrate;

a second substrate facing the first substrate;

a second electrode formed on the second substrate and facing the first electrode;

a liquid crystal layer formed between the first and second electrodes and filled with liquid crystals; and a plurality of charge supplying units supplying charges to the first electrode several times to apply a bend voltage for transitioning an arrangement of the liquid crystals.

2. The liquid crystal display of claim 1, wherein the alignment of the liquid crystals is changed from a splay alignment to a bend alignment by the alignment transition of the liquid crystals.

3. The liquid crystal display of claim 2, wherein the charge supplying unit applies the bend voltage to the first electrode before the liquid crystal display displays images.

4. The liquid crystal display of claim 3, wherein the charge supplying unit applies a common voltage to the first electrode while the liquid crystal display displays images.

5. The liquid crystal display of claim 4, wherein the charge supplying unit comprises:

a capacitor connected to the common voltage and a reference node;

a first switching element connected to the bend voltage source and the reference node; and a second switching element connected to the reference node and the first electrode.

6. The liquid crystal display of claim 5, wherein the first and second switching elements are alternately turned on.

7. The liquid crystal display of claim 6, wherein the bend voltage is larger than the common voltage.

8. The liquid crystal display of claim 7, wherein the charge supplying unit further comprises a third switching element connected to the common voltage and the first electrode, and the third switching element is turned on after the first electrode is charged with the bend voltage.

9. The liquid crystal display of claim 8, wherein the bend voltage increases as time elapses.

10. A driving method of a liquid crystal display having a first substrate, a first electrode forming on the first substrate, a second substrate facing the first substrate, a second electrode formed on the second substrate and facing the first electrode, and a liquid crystal layer formed between the first and second electrodes and filled with liquid crystals, the driving method comprising:

supplying charges to the first electrode several times to apply a bend voltage for transiting an arrangement of the liquid crystals;

applying a common voltage to the first electrode; and applying a data voltage to the second electrode to display an image.

11. The driving method of claim 10, wherein the liquid crystal display comprises:

a capacitor connected to the common voltage and a reference node;

a first switching element connected to the bend voltage and the reference node; and a second switching element connected to the reference node and the first electrode, wherein the charge supply comprises supplying the bend voltage to charge the capacitor by turning on the first switching element, and supplying the charge from the capacitor to the first electrode by turning on the second switching element.

12. The driving method of claim 11, wherein the bend voltage is larger than the common voltage.

13. The driving method of claim 12, wherein the bend voltage increases as time elapses.

* * * * *